US009062550B2

(12) United States Patent
Nishikawa et al.

(10) Patent No.: US 9,062,550 B2
(45) Date of Patent: Jun. 23, 2015

(54) VANE PUMP

(75) Inventors: Toshio Nishikawa, Tochigi (JP); Hiroyuki Ishihama, Tochigi (JP); Naoya Taga, Tochigi (JP)

(73) Assignee: SHOWA CORPORATION, Saitama (JP)

( * ) Notice: Subject to any disclaimer, the term of this patent is extended or adjusted under 35 U.S.C. 154(b) by 157 days.

(21) Appl. No.: 13/424,349

(22) Filed: Mar. 19, 2012

(65) Prior Publication Data

US 2013/0052071 A1 Feb. 28, 2013

(30) Foreign Application Priority Data

Aug. 23, 2011 (JP) ..... 2011-181933

(51) Int. Cl.

| | |
|---|---|
| ***F01C 1/00*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/00*** | (2006.01) |
| ***F04C 15/00*** | (2006.01) |
| ***F04C 29/00*** | (2006.01) |
| ***F01C 21/08*** | (2006.01) |
| ***F01C 21/10*** | (2006.01) |
| ***F04C 2/344*** | (2006.01) |

(52) U.S. Cl.

CPC ..... *F01C 21/0863* (2013.01); *F01C 21/108* (2013.01); *F04C 2/3446* (2013.01)

(58) Field of Classification Search

CPC ..... F01C 21/0818; F01C 21/0863; F01C 21/108; F04C 2/3446; F04C 18/344

USPC ..... 418/259–270

See application file for complete search history.

(56) References Cited

U.S. PATENT DOCUMENTS

| | | | | |
|---|---|---|---|---|
| 5,188,522 | A * | 2/1993 | Hara | 418/77 |
| 6,648,620 | B2 * | 11/2003 | Yamauchi et al. | 418/259 |
| 6,877,969 | B2 * | 4/2005 | Yao et al. | 418/268 |
| 7,347,677 | B2 * | 3/2008 | Ide et al. | 418/132 |

FOREIGN PATENT DOCUMENTS

| | | |
|---|---|---|
| JP | 2000-265977 | 9/2000 |
| JP | 2007-120435 | 5/2007 |
| JP | 2007-126786 | 6/2007 |

* cited by examiner

*Primary Examiner* — Mary A Davis
*Assistant Examiner* — Deming Wan
(74) *Attorney, Agent, or Firm* — Keith Orum; Orum & Roth LLC

(57) ABSTRACT

A back pressure groove which is formed in a plate coming into contact with a side surface of a rotor and is communicated with a high pressure chamber is formed in such a manner as to copy an annular locus drawn by a base end of a vane which slides within a vane groove while coming into slidable contact with a cam surface of a cam ring, at a time when the rotor rotates one time.

11 Claims, 7 Drawing Sheets

VANE PUMP

BACKGROUND OF THE INVENTION

1. Field of the Invention

The present invention relates to a vane pump.

2. Description of the Related Art

As a vane pump, as described in Japanese Patent Application Laid-Open No. 2007-120435 (patent document 1), there is a structure having a housing, a rotor which is arranged in an inner portion of the housing so as to rotate, and a plurality of vanes which are slidably arranged in a plurality of vane grooves provided in a diametrical direction of the rotor. A tubular cam ring is arranged in such a manner as to surround the rotor in an inner portion of the housing. A pair of plates pinch the rotor, the vanes and a cam ring from both sides. A high pressure chamber is provided between the housing and one of the pair of plates, and is supplied a liquid discharged on the basis of a rotation of the rotor. A back pressure groove is formed in a surface coming into contact with a side surface of the rotor in one of the pair of plates, communicates with a space close to a bottom portion of the vane groove defined by a base end of the vane within the vane groove whatever rotational position of the rotor, and communicates with the high pressure chamber. A fluid supplied to the high pressure chamber is introduced to the space close to the bottom portion of the vane groove of the rotor via the back pressure groove formed in the one plate. A leading end of the vane is brought into contact with the cam surface in an inner periphery of the cam ring on the basis of the pressure of the fluid which is introduced to the space close to the bottom portion of the vane groove.

In accordance with this, in the vane pump described in the patent document 1, the leading end of the vane is pressed against the cam surface of the cam ring on the basis of a centrifugal force at the start of the rotation of the rotor. However, after a discharge pressure is generated, the discharge pressure is conducted to the back pressure groove, and the leading end of the vane which is pushed out by the discharge pressure increases a contact pressure of the cam ring with the cam surface, thereby securely achieving a trap of the pressure fluid which is pressurized between the adjacent vanes.

In the prior art, the back pressure groove formed in the one plate is formed as an annular shape of a complete round. On the other hand, a space close to the bottom portion of the vane groove which is defined by a base end of the vane within the vane groove provided in a diametrical direction of the rotor is defined by the base end of the vane and is formed in the smallest diameter side of the rotor, at the maximum pressing rotational position at which each of the vanes rotating together with the rotor is pressed into the vane groove on the basis of the contact with the cam surface of the cam ring to the maximum.

Therefore, whatever rotational position the rotor exists, a diameter of the annular ring mentioned above of the back pressure groove to be inserted into the space close to the bottom portion of the vane groove in the rotor comes to a smaller diameter than the base end position of the vane at the maximum pressing rotational position mentioned above, since the back pressure groove is formed as the annular shape of the complete round.

This means that a distance becomes smaller in all the areas in a periphery direction of the back pressure groove, the distance being formed by the back pressure groove formed in the one plate with respect to a center hole of the one plate through which a rotating shaft of the rotor passes. In other words, the distance being a seal width which prevents the discharge pressure guided to the back pressure groove from leaking to the center hole via a side clearance between the plate and the rotor. In the prior art, the discharge pressure guided to the back pressure groove formed in the one plate tends to leak to the center hole which passes through the plate.

In the case that a side clearance between the one plate and the rotor is made smaller in order to prevent the leak of the discharge pressure mentioned above, there is caused a disadvantage which deteriorates a sticking toughness of the rotor.

SUMMARY OF THE INVENTION

An object of the present invention is to inhibit a discharge pressure guided to a back pressure groove formed in a plate coming into contact with a side surface of a rotor from leaking to a center hole for a rotating axis of the rotor passing through the plate.

In one embodiment of the present invention, there is provided a vane pump which has a housing. A rotor is arranged in an inner portion of the housing so as to rotate. A plurality of vanes are slidably arranged in a plurality of vane grooves provided in a diametrical direction of the rotor. A tubular cam ring is arranged in such a manner as to surround the rotor in the inner portion of the housing. A pair of plates pinch the rotor, the vanes and the cam rings from both sides. A high pressure chamber is provided between the housing and one of the pair of plates, and is supplied a liquid discharged on the basis of a rotation of the rotor. Back pressure grooves which are formed in a surface coming into contact with a side surface of the rotor in at least one of the pair of plates are communicated with a space close to a bottom portion of the vane groove defined by a base end of the vane within the vane groove whatever rotational position the rotor is, and are communicated with the high pressure chamber. The fluid being supplied to the high pressure chamber is introduced into the space close to the bottom portion of the vane groove of the rotor via the back pressure groove formed in the at least one plate. A leading end of the vane is brought into contact with a cam surface in an inner periphery of the cam ring on the basis of a pressure of the fluid which is introduced into the space close to the bottom portion of the vane groove. The back pressure groove is formed in such a manner as to copy an annular locus drawn by the base end of the vane coming into slidable contact with the cam surface of the cam ring so as to slide within the vane groove, at a time when the rotor rotates one time.

In another embodiment, the back pressure grooves are formed in such a manner as to communicate with each other in line with a portion which is farthest away from the center of the rotor in the space close to the bottom portion of the vane groove defined by the base end of the vane, at each of the rotational positions in one rotation of the rotor.

In another embodiment the back pressure groove is formed as a similar shape to a cam curve of the cam surface along a peripheral direction of the cam ring.

In another embodiment the back pressure groove is formed as an annular shape of an oval.

In another embodiment the back pressure groove is formed only in one of a pair of plates.

In another embodiment the back pressure groove is formed in both of a pair of plates.

In another embodiment the vane pump is a fixed displacement type vane pump.

In accordance with the present embodiment, the following operations and effects can be achieved.

(a) The back pressure groove which is formed in the plate coming into contact with the side surface of the rotor and communicates with the high pressure chamber is formed in such a manner as to copy the annular locus drawn by the base end of the vane which comes into slidable contact with the cam surface of the cam ring and slides within the vane groove when the rotor rotates once.

Further, it is preferable that the back pressure grooves are formed in such a manner as to communicate with each other in line with a portion which is farthest away from the center of the rotor in the space close to the bottom portion of the vane groove defined by the base end of the vane, at each of the rotational positions in one rotation of the rotor.

Therefore, when each of the vanes which rotate together with the rotor is at the maximum pressing rotational position which is pressed into the vane groove to the maximum by the cam surface of the cam ring, the distance is small. The distance is formed by the back pressure groove which is formed in the plate in such a manner as to be communicated with the space close to the bottom portion of the vane groove defined by the base end of the vane pressed into the vane groove to the maximum, with respect to the center hole for the rotating shaft of the rotor passing through the plate.

However, the back pressure groove is formed in such a manner as to copy the annular locus drawn by the base end of the vane at a time when the rotor rotates one time, without being formed as the annular shape of the complete round. In accordance with this, when each of the vanes which rotate together with the rotor is at the maximum pushing out rotational position at which it is pushed out of the vane groove to the maximum by the cam surface of the cam ring, the distance is large. The distance is formed by the back pressure groove which is formed in the plate in such a manner as to be communicated with the space close to the bottom portion of the vane groove defined by the base end of the vane pushed out of the vane groove to the maximum, with respect to the center hole for the rotating shaft of the rotor passing through the plate.

In this case, another words, the distances mentioned above which the back pressure groove formed in the plate forms with respect to the center hole for the rotating shaft of the rotor passing through the plate are the seal widths which prevent the discharge pressure conducted to the back pressure groove from leaking to the center hole via the side clearance between the plate and the rotor. In accordance with the present invention, the seal widths change little by little in the peripheral direction of the back pressure groove, and becomes larger in a side of the position corresponding to the maximum pushing out rotational position of the rotor. In accordance with this, it is possible to inhibit the discharge pressure conducted to the back pressure groove formed in the plate from leaking to the center hole for the rotating shaft of the rotor passing through the plate, without making the side clearance between the plate which comes into contact with the side surface of the rotor, and the rotor small.

(b) The back pressure groove in the item (a) mentioned above is formed as a similar shape to the cam curve of the cam surface along the peripheral direction of the cam ring. In accordance with this, it is possible to form the back pressure groove in such a manner as to completely copy the annular locus which the base end of the vane in the item (a) mentioned above draws, and it is possible to securely inhibit the discharge pressure conducted to the back pressure groove from leaking to the center hole for the rotating shaft of the rotor.

(c) The back pressure groove in the item (a) mentioned above is formed as the annular shape of the oval. In accordance with this, it is possible to form the back pressure groove in such a manner as to copy the annular locus which the base end of the vane in the item (a) mentioned above draws, and it is possible to easily inhibit the discharge pressure conducted to the back pressure groove from leaking to the center hole for the rotating shaft of the rotor.

(d) The item (a) mentioned above can be achieved by forming the back pressure groove in the item (a) mentioned above only in one of a pair of plates.

(e) The item (a) mentioned above can be achieved by forming the back pressure groove in the item (a) mentioned above in both of a pair of plates.

BRIEF DESCRIPTION OF THE DRAWINGS

The present invention will be more fully understood from the detailed description given below and from the accompanying drawings which should not be taken to be a limitation on the invention, but are for explanation and understanding only.

The Drawings.

DESCRIPTION OF THE PREFERRED EMBODIMENTS

Figure 1:
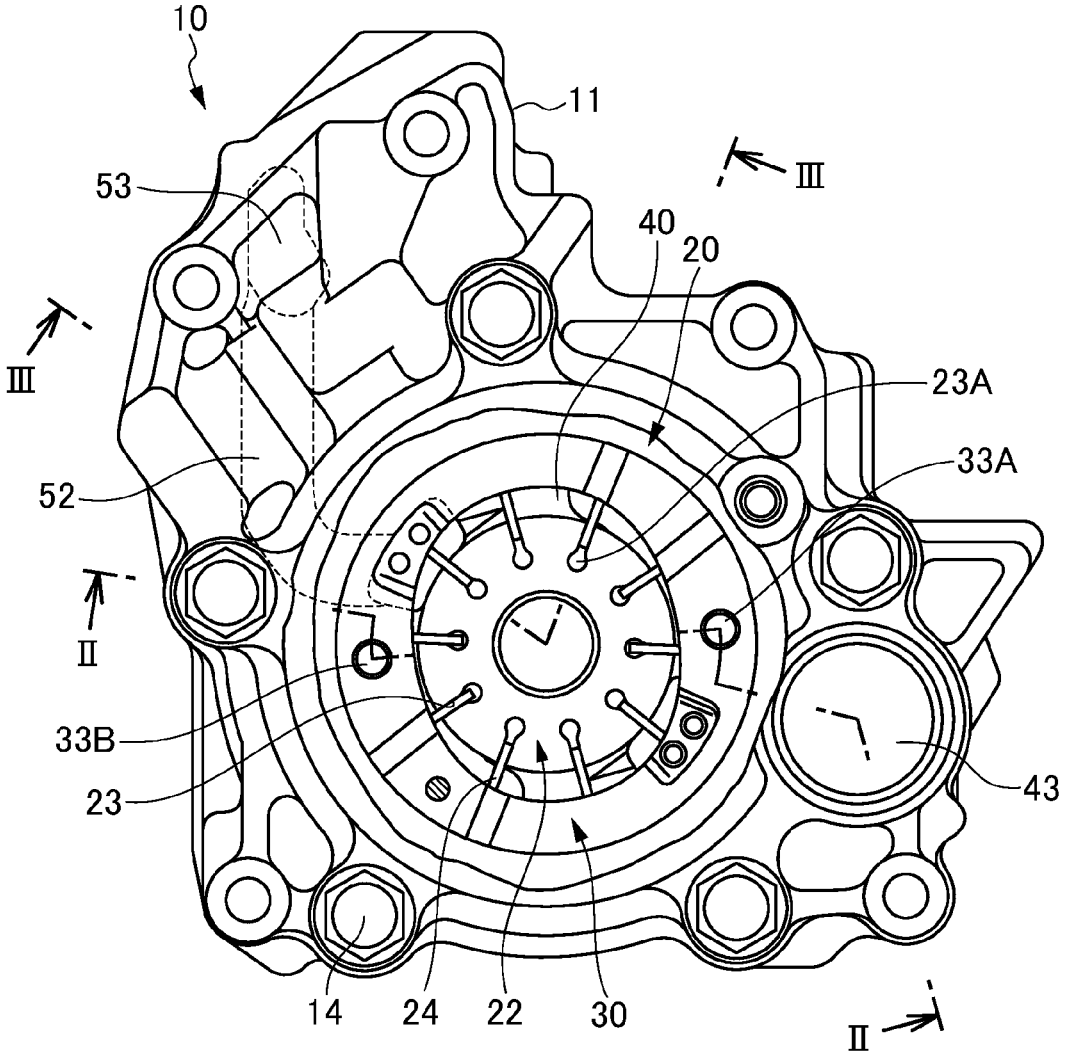
FIG. 1 is a side cross sectional view showing a vane pump.
Figure 2:
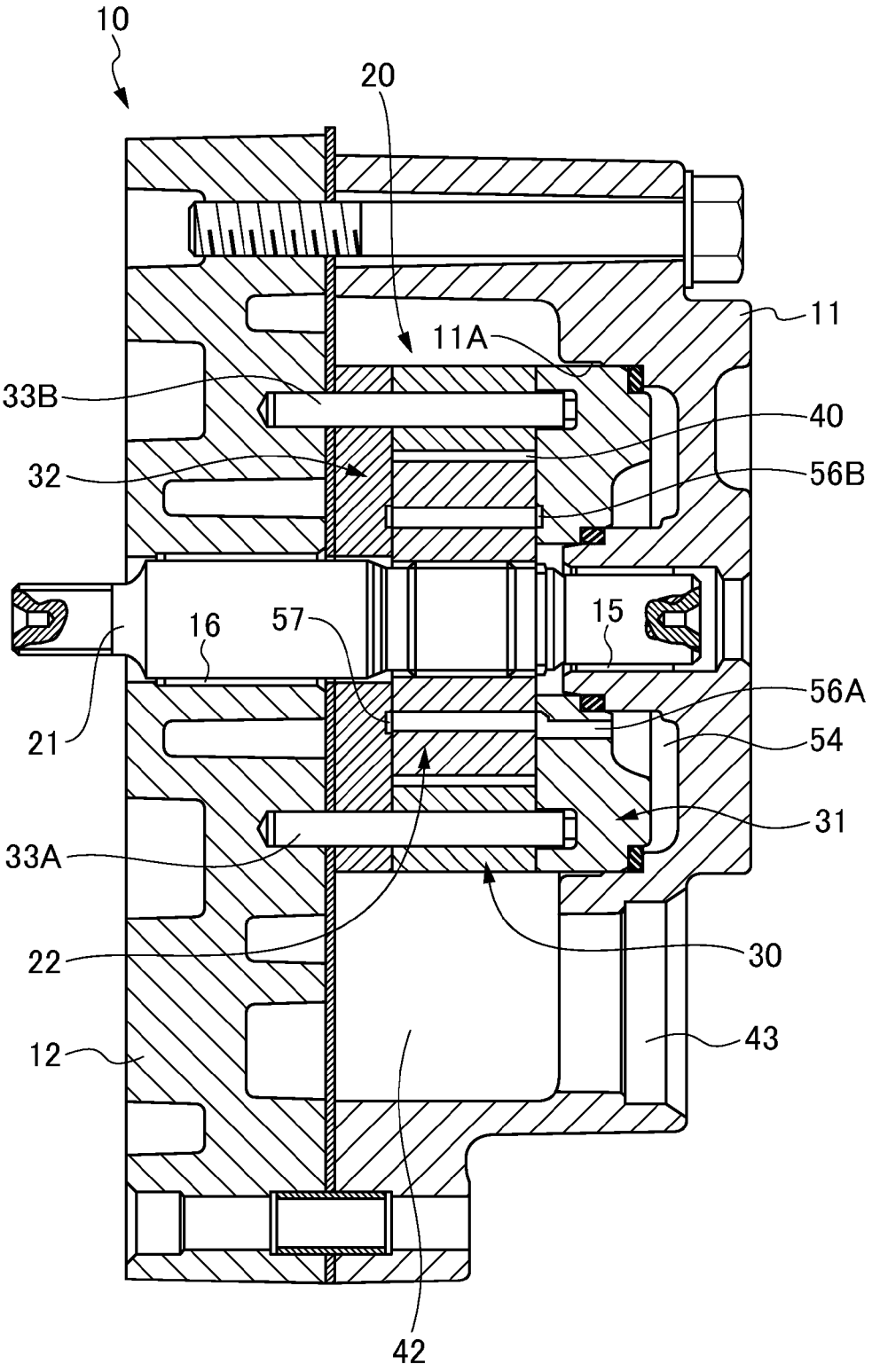
FIG. 2 is a cross sectional view along a line II-II in FIG. 1.
Figure 3:
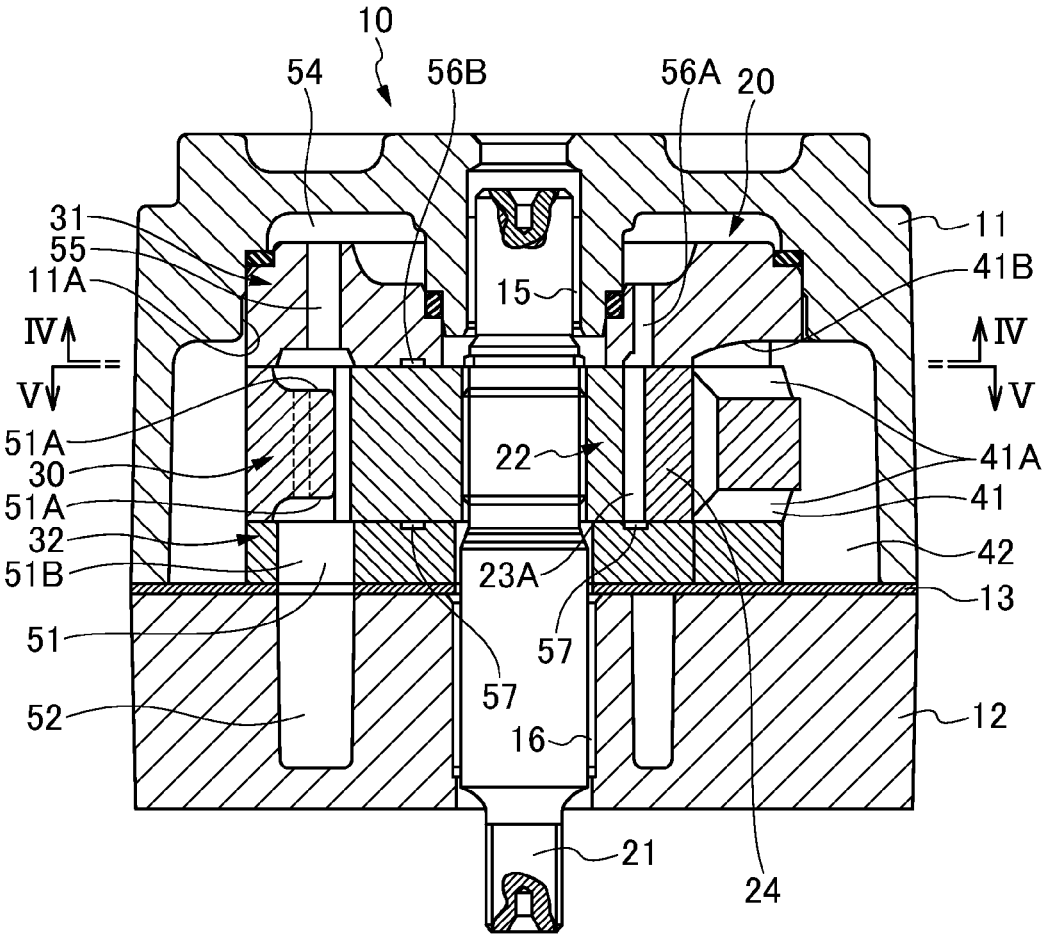
FIG. 3 is a cross sectional view along a line III-III in FIG. 1.

A vane pump 10 shown in FIG. 1 to FIG. 5 is a fixed displacement type vane pump. The vane pump 10 is driven, for example, by power of an internal combustion engine, and is employed as an oil pump for supplying a working fluid serving as a fluid to a fluid pressure utilizing equipment, for example, a hydraulic power steering and a hydraulic continuously variable transmission.

The vane pump 10 has a housing 11 which is provided with a concave portion (an accommodating chamber) 11A accommodating a pump unit 20, a cover plate 12 which covers an opening portion of the concave portion 11A of the housing 11, and a seal plate 13 which is pinched between the housing 11 and the cover plate 12. The housing 11, the cover plate 12 and the seal plate 13 are fastened by a plurality of bolts 14 so as to be fixed. The seal plate 13 covers a plurality of passage grooves or lightening grooves which are formed in the housing 11 and the cover plate 12 so as to seal.

The vane pump 10 is structured such that a rotating shaft 21 of the pump unit 20 is pivoted to bearings 15 and 16 which are provided in the housing 11 and the cover plate 12, and a rotor 22 fixedly connected to the rotating shaft 21 via a serration is arranged in the concave portion 11A of the housing 11. The rotating shaft 21 and the rotor 22 are rotated by power of the internal combustion engine.

Figure 5:
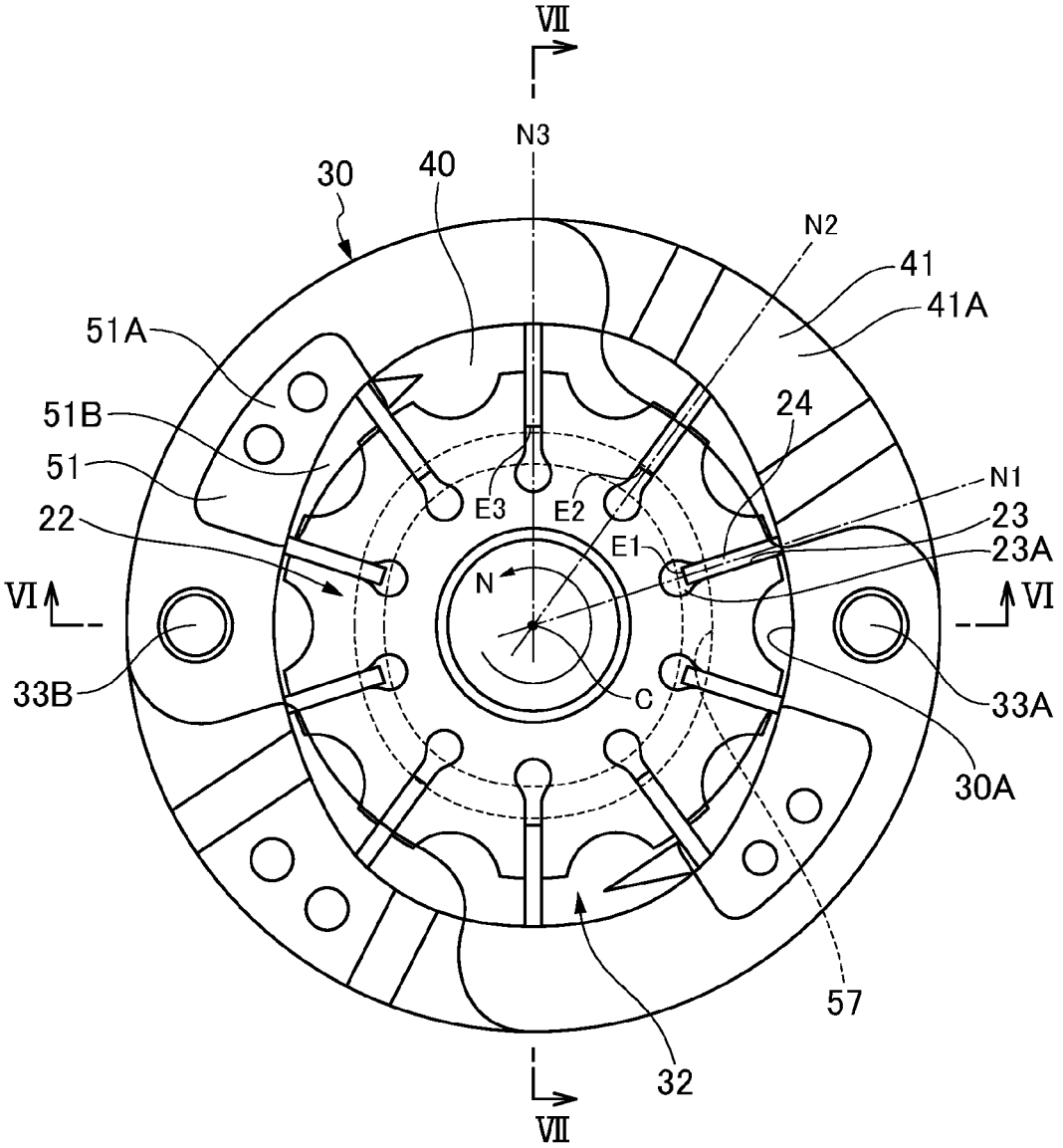
FIG. 5 is a view as seen from an arrow along a line V-V in FIG. 3.

The rotor 22 is structured, as shown in FIG. 5, such that a vane 24 is accommodated in a vane groove 23 which is provided in a diametrical direction so as to freely rise and set, at each of a lot of positions along a peripheral direction, and each of the vanes 24 is slidably arranged in a radial direction along the vane groove 23. The rotor 22 makes the vane groove 23 open to an outer peripheral surface and both side surfaces.

The pump unit 20 is fitted and attached to the concave portion 11A of the housing 11, in such a manner that an inner side plate 31, a cam ring 30, and an outer side plate 32 are laminated in this order from a far side of the concave portion 11A. These inner side plate 31, the cam ring 30 and the outer side plate 32 are fixedly retained by the cover plate 12 from a lateral side in a state of being skewered by positioning pins 33A and 33B so as to be positioned in the peripheral direction, together with the seal plate 13 which is additionally provided in the outer side plate 32. In this case, the side plates 31 and 32 are formed as a perforated disc shape, and have center holes 31A and 32A into which the rotating shaft 21 of the rotor 22 is inserted.

The cam ring 30 is formed as a tubular shape which has a circular outer peripheral surface, and an inner peripheral surface forming a cam surface 30A (FIG. 5) by a cam curve which is similar to an oval, is fitted and attached to the concave portion 11A of the housing 11, and surrounds the rotor 22.

The inner side plate 31 and the outer side plate 32 construct a pair of plates which pinch the rotor 22, the vane 24 and the cam ring 30 from both sides. Accordingly, the cam ring 30 surrounds the rotor 22 and the vane 24 between both the side plates 31 and 32, and forms a pump chamber 40 between an outer peripheral surface of the rotor 22 and the adjacent vanes 24.

In the pump unit 20, in a suction area in an upstream side of a rotor rotating direction of the pump chamber 40, a suction port 41 (a suction port 41A and a suction port 41B) which are provided in the cam ring 30 and the inner side plate 31 are open, and a suction port 43 of the pump 10 is communicated with the suction port 41 via a suction passage 42 which is provided in the housing 11. In conjunction with the rotation of the rotor 22, oil is sucked into a suction region in which the pump chamber 40 is expanded.

On the other hand, discharge ports 51 which are provided in the cam ring 30 and the outer side plate 32 is open to a discharge area in a downstream side of the rotor rotating direction of the pump chamber 40, and a discharge port 53 of the pump 10 is communicated with the discharge port 51 (a discharge port 51A and a discharge port 51B) via a discharge passage 52 which is provided in the cover plate 12. In conjunction with the rotation of the rotor 22, the oil is discharged from a discharge area in which the pump chamber 40 is compressed.

In this case, when the vane 24 rotating together with the rotor 22 is at a rotating angle position heading for the suction area from the discharge area mentioned above (which is also called as a maximum pressing rotational position of the vane 24), during one rotation of the rotor 22, the vane 24 is pressed into the vane groove 23 most deeply by the cam surface 30A of the cam ring 30. Further, when the vane 24 is at a rotating angle position heading for the discharge area from the suction area mentioned above (which is also called a maximum pushing out rotational position of the vane 24), the vane 24 is pushed out most significantly to an outer side of the vane groove 23 by the cam surface 30A of the cam ring 30.

The pump unit 20 is provided with a high pressure chamber 54 which is defined by the inner side plate 31, in a farthest portion of the concave portion 11A of the housing 11. The inner side plate 31 has a high pressure oil supply port 55 which communicates the discharge port 51 provided in the cam ring 30 with the high pressure chamber 54, and the oil discharged from the pump chamber 40 on the basis of the rotation of the rotor 22 is supplied to the high pressure chamber 54.

Figure 4:
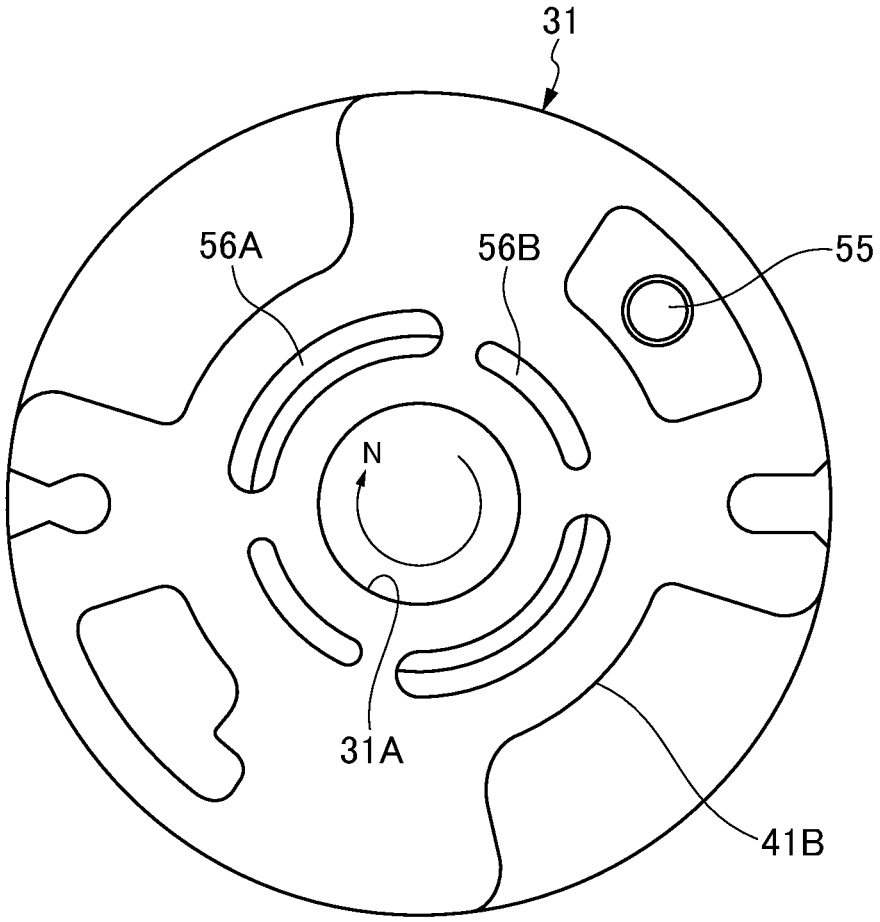
FIG. 4 is a view as seen from an arrow along a line IV-IV in FIG. 3.

The inner side plate 31 is structured, as shown in FIG. 4 and FIG. 5, such that a circular arc shaped high pressure oil introduction port 56A conducting the high pressure discharge oil in the high pressure chamber 54 to a space 23A close to a bottom portion of the vane groove 23 in a part of the peripheral direction of the rotor 22 is provided at two positions which are opposed to each other around the center hole 31A on the same diameter of the inner side plate 31. Further, the outer side plate 32 is provided in a surface which comes into contact with another side surface of the rotor 22, with an annular back pressure groove 57 which is communicated with the space 23A close to the bottom portion of the vane groove 23 in a whole portion of the rotor 22, and is communicated with the high pressure chamber 54 via the high pressure oil introduction port 56A mentioned above of the inner side plate 31. In this case, the inner side plate 31 is provided with a circular arc shaped communication groove 56B which is communicated with the space 23A close to the bottom portion of the vane groove 23 in a part of the peripheral direction of the rotor 22, at two positions which are pinched by the adjacent two high pressure oil introduction ports 56A and 56A on the surface coming into contact with the one side surface of the rotor 22.

In this case, the high pressure oil introduction port 56A of the inner side plate 31, the communication groove 56B and the back pressure groove 57 of the outer side plate 32 are set in such a manner as to be communicated with the space 23A close to the bottom portion of the vane groove 23 which is defined by base ends Ei (i=1, 2, 3, . . . ) of the vane 24 within the vane groove 23, whatever rotational position Ni (i=1, 2, 3, . . . ) the rotor 22 is provided at in a rotating direction N. In this case, in FIG. 5, reference symbol N1 corresponds to a maximum pressing rotational position of the vane 24, and reference symbol N3 corresponds to a maximum pushing out rotational position of the vane 24.

In accordance with this, the high pressure discharge oil which is discharged from the pump chamber 40 so as to be supplied to the high pressure chamber 54 on the basis of the rotation of the rotor 22 is supplied to the annular back pressure groove 57 of the outer side plate 32 via the high pressure oil introduction port 56A of the inner side plate 31, and further via the space 23A close to the bottom portion of the vane groove 23 in a part of the rotor 22 with which the high pressure oil introduction port 56A is communicated. Further, the high pressure discharge oil supplied to the annular back pressure groove 57 of the outer side plate 32 is simultaneously introduced to the space 23A close to the bottom portion of the vane groove 23 in a whole portion of the rotor 22 with which the back pressure groove 57 is communicated, and presses the leading end of the vane 24 against the cam surface 30A in the inner periphery of the cam ring 30 on the basis of the pressure of the high pressure discharge oil which is introduced to the space 23A close to the bottom portion of the vane groove 23 so as to bring it into contact. In this case, the high pressure discharge oil which is introduced to the space 23A close to the bottom portion of the vane groove 23 of the rotor 22 which is not communicated with the high pressure oil introduction port 56A of the inner side plate 31 is pressed into the communication groove 56B of the inner side plate 31 so as to be filled.

Accordingly, in the vane pump 10, if the rotating shaft 21 is rotated by the internal combustion engine, and the leading end of the vane 24 of the rotor 22 is pressed against the cam surface 30A in the inner periphery of the cam ring 30 so as to be rotated, the oil from the suction port 41 is sucked into the pump chamber 40 which is expanded in conjunction with the rotation of the rotor 22, in the suction area in the upstream side of the rotor rotating direction of the pump chamber 40. At the same time, in the discharge area in the downstream side of the rotor rotating direction of the pump chamber 40, the oil from the pump chamber 40 which is compressed in conjunction with the rotation of the rotor 22 is discharged to the discharge port 51.

Accordingly, in the vane pump 10, as shown in FIG. 5, when the rotor 22 rotates one time at each of the rotational positions Ni (i=1, 2, 3, . . . ) along the rotating direction N, the back pressure groove 57 of the outer side plate 32 is formed in such a manner as to copy the annular locus which is drawn by the base ends Ei (i=1, 2, 3, . . . ) of the vane 24 which slides within the vane groove 23 while coming into slidable contact with the cam surface 30A of the cam ring 30.

In accordance with this, the back pressure groove 57 of the outer side plate 32 is formed in such a manner as to be communicated in line with the portion which is farthest to the outer side in the radial direction from the center c of the rotor 22 (the portion which comes into contact with the base end Ei of the vane 24), in the space 23A close to the bottom portion of the vane groove 23 which is defined by the base end Ei of the vane 24, at each of the rotational positions Ni at which the rotor 22 rotates at one time (FIG. 5).

In this case, it is preferable that the back pressure groove 57 of the outer side plate 32 is formed as a similar shape to the cam curve of the cam surface 30A of the cam ring 30. In this case, the back pressure groove 57 may be formed as an annular shape of an oval which is approximately similar to the cam curve of the cam surface 30A.

Therefore, in accordance with the present embodiment, the following operations and effects can be achieved.

Figure 6:
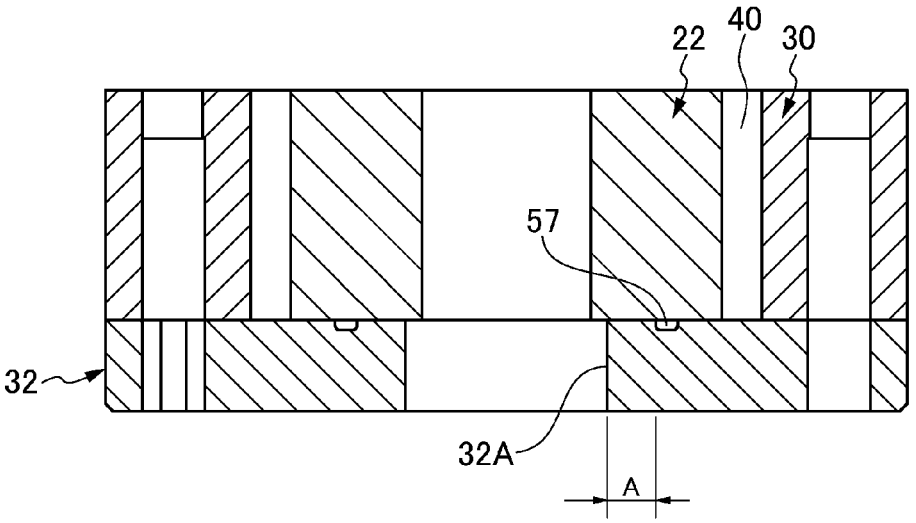
FIG. 6 is a cross sectional view along a line VI-VI in FIG. 5.

(a) When each of the vanes 24 which rotate together with the rotor 22 is at the maximum pressing rotational position N1 which is pressed into the vane groove 23 to the maximum by the cam surface 30A of the cam ring 30, the distance A is small. The distance A is formed by the back pressure groove 57 which is formed in the outer side plate 32 in such a manner as to be communicated with the space 23A close to the bottom portion of the vane groove 23 defined by the base end E1 of the vane 24 pressed into the vane groove 23 to the maximum, with respect to the center hole 32A for the rotating shaft 21 of the rotor 22 passing through the outer side plate 32, as shown in FIG. 5 (FIG. 6).

Figure 7:
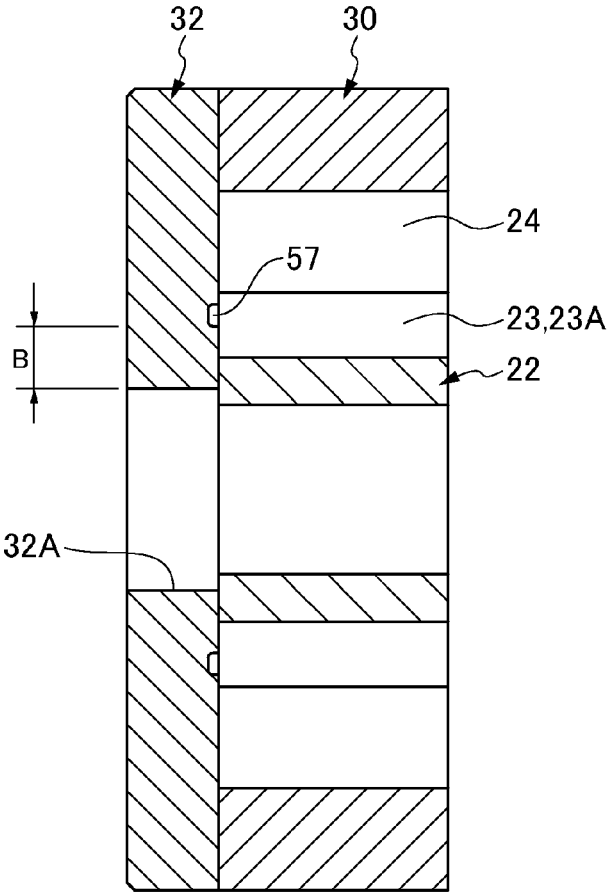
FIG. 7 is a cross sectional view along a line VII-VII in FIG. 5.

However, the back pressure groove 57 is formed in such a manner as to copy the annular locus drawn by the base end Ei of the vane 24 at a time when the rotor 22 rotates one time, without being formed as the annular shape of the complete round. In accordance with this, when each of the vanes 24 which rotate together with the rotor 22 is at the maximum pushing out rotational position N3 at which it is pushed out of the vane groove 23 to the maximum by the cam surface 30A of the cam ring 30, the distance B is large. The distance B is formed by the back pressure groove 57 which is formed in the outer side plate 32 in such a manner as to be communicated with the space 23A close to the bottom portion of the vane groove 23 defined by the base end E3 of the vane 24 pushed out of the vane groove 23 to the maximum, with respect to the center hole 32A for the rotating shaft 21 of the rotor 22 passing through the outer side plate 32, as shown in FIG. 5 (FIG. 7).

In this case, in other words, the distances A and B mentioned above which the back pressure groove 57 formed in the outer side plate 32 forms with respect to the center hole 32A for the rotating shaft 21 of the rotor 22 passing through the outer side plate 32 are the seal widths A and B which prevent the discharge pressure conducted to the back pressure groove 57 from leaking to the center hole 32A via the side clearance between the outer side plate 32 and the rotor 22. In accordance with the present invention, the seal widths change little by little in the peripheral direction of the back pressure groove 57, and becomes larger in a side of the position corresponding to the maximum pushing out rotational position of the rotor 22. In accordance with this, it is possible to inhibit the discharge pressure conducted to the back pressure groove 57 formed in the outer side plate 32 from leaking to the center hole 32A for the rotating shaft 21 of the rotor 22 passing through the outer side plate 32, without making the side clearance between the outer side plate 32 which comes into contact with the side surface of the rotor 22, and the rotor 22 small.

Figure 8A:
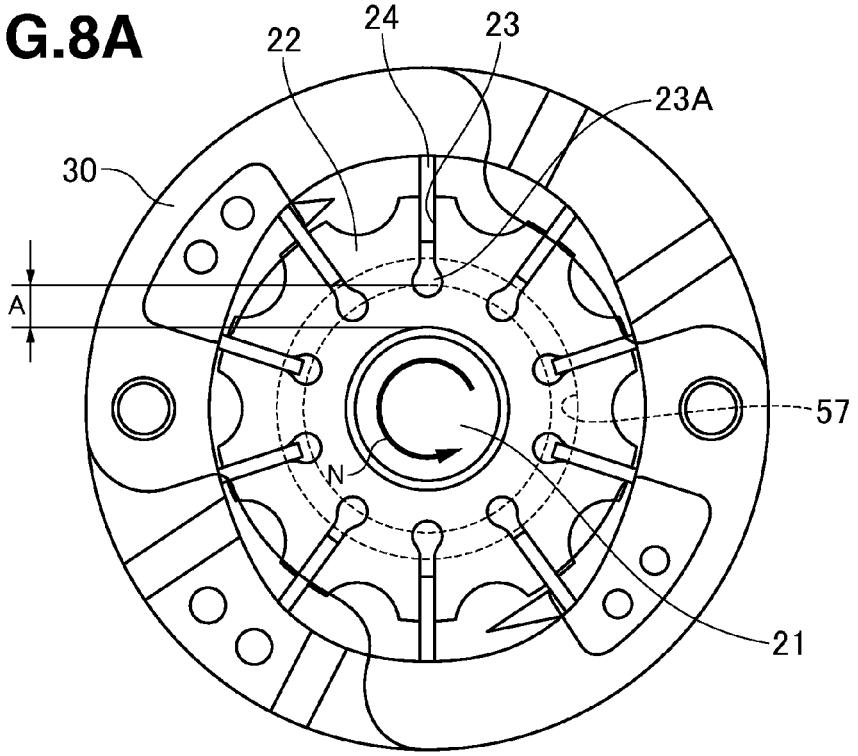
FIGS. 8A and 8B are schematic views showing an effect of enlarging a seal width in accordance with the present invention.
Figure 8B:
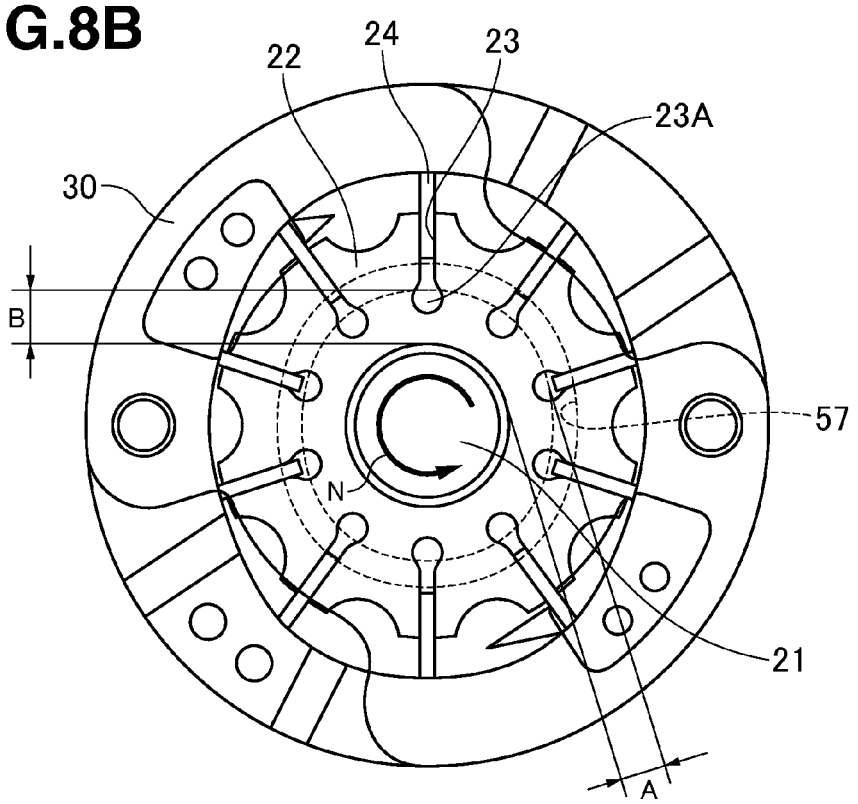

FIG. 8A shows a conventional example in which the back pressure groove 57 of the outer side plate 32 is set to the annular shape of the complete round, and FIG. 8B shows the embodiment in accordance with the present invention mentioned above.

(b) The back pressure groove 57 in the item (a) mentioned above is formed as a similar shape to the cam curve of the cam surface 30A along the peripheral direction of the cam ring 30. In accordance with this, it is possible to form the back pressure groove 57 in such a manner as to completely copy the annular locus which the base end Ei of the vane 24 in the item (a) mentioned above draws, and it is possible to securely inhibit the discharge pressure conducted to the back pressure groove 57 from leaking to the center hole 32A for the rotating shaft 21 of the rotor 22.

(c) The back pressure groove 57 in the item (a) mentioned above is formed as the annular shape of the oval. In accordance with this, it is possible to form the back pressure groove 57 in such a manner as to copy the annular locus which the base end of the vane 24 in the item (a) mentioned above draws, and it is possible to easily inhibit the discharge pressure conducted to the back pressure groove 57 from leaking to the center hole 32A for the rotating shaft 21 of the rotor 22.

(d) The item (a) mentioned above can be achieved by forming the back pressure groove 57 in the item (a) mentioned above only in the outer side plate 32 which corresponds to one of a pair of side plates 31 and 32.

In this case, the item (a) mentioned above can be achieved by forming the back pressure groove 57 in the item (a) mentioned above in both of a pair of side plates 31 and 32. At this time, it is assumed that the back pressure groove 57 is provided in the outer side plate 32, the similar back pressure groove to the back pressure groove 57 is provided in the surface which comes into contact with the rotor 22 in the inner side plate 31, and the high pressure oil introduction port 56A provided in the inner side plate 31 is communicated with the back pressure groove.

As heretofore explained, embodiments of the present invention have been described in detail with reference to the drawings. However, the specific configurations of the present invention are not limited to the illustrated embodiments but those having a modification of the design within the range of the presently claimed invention are also included in the present invention. For example, the present invention is not limited to the fixed displacement type vane pump, but can be applied, for example, to the variable displacement type vane pump as described in Japanese Patent Application Laid-Open Nos. 2000-265977 and 2007-146786.

In accordance with the present invention, there is provided a vane pump having a housing. A rotor is arranged in an inner portion of the housing so as to rotate. A plurality of vanes are slidably arranged in a plurality of vane grooves provided in a diametrical direction of the rotor. A tubular cam ring which is arranged in such a manner as to surround the rotor in the inner portion of the housing. A pair of plates pinch the rotor, the vanes and the cam rings from both sides. A high pressure chamber is provided between the housing and one of the pair of plates, and is supplied a liquid discharged on the basis of a rotation of the rotor. Back pressure grooves are formed in a surface coming into contact with a side surface of the rotor in at least one of the pair of plates, are communicated with a space close to a bottom portion of the vane groove defined by a base end of the vane within the vane groove whatever rotational position the rotor is, and are communicated with the high pressure chamber. The fluid being supplied to the high pressure chamber is introduced into the space close to the bottom portion of the vane groove of the rotor via the back pressure groove formed in the at least one plate. A leading end of the vane is brought into contact with a cam surface in an inner periphery of the cam ring on the basis of a pressure of the fluid which is introduced into the space close to the bottom portion of the vane groove. The back pressure groove is formed in such a manner as to copy an annular locus drawn by the base end of the vane coming into slidable contact with the cam surface of the cam ring so as to slide within the vane groove, at a time when the rotor rotates one time. Accordingly, it is possible to inhibit a discharge pressure guided to a back pressure groove formed in a plate coming into contact with a side surface of a rotor from leaking to a center hole for a rotating axis of the rotor passing through the plate.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be encompassed within a scope of equivalents thereof with respect to the features set out in the appended claims.

What is claimed is:

1. A vane pump comprising:

a housing; and a rotor which is arranged in an inner portion of the housing so as to rotate;

a plurality of vanes which are slidably arranged in a plurality of vane grooves provided in a diametrical direction of the rotor;

a tubular cam ring which is arranged in such a manner as to surround the rotor in the inner portion of the housing;

a pair of plates which pinch the rotor, the vanes and the cam rings from both sides;

a high pressure chamber which is provided between the housing and one of the pair of plates, and is supplied a fluid discharged on the basis of a rotation of the rotor;

a back pressure groove which is formed in a surface coming into contact with a side surface of the rotor in at least one of the pair of plates, is communicated with a space close to a bottom portion of each of the vane grooves and defined by a base end of the vane within the vane groove whatever rotational position the rotor is, and is communicated with the high pressure chamber; and the fluid being supplied to the high pressure chamber is introduced into the space close to the bottom portion of the vane groove of the rotor via the back pressure groove formed in the at least one plate, and bringing a leading end of the vane into contact with a cam surface in an inner periphery of the cam ring on the basis of a pressure of the fluid which is introduced into the space close to the bottom portion of the vane groove, wherein the back pressure groove is formed in such a manner as to copy an annular locus drawn by the base end of the vane coming into slidable contact with the cam surface of the cam ring so as to slide within the vane groove, at a time when the rotor rotates one time, the back pressure groove is formed in such a manner as to communicate with the space close to the bottom portion of each of the vane grooves, and the space does not include the bottom portion of each of the vane grooves, the back pressure groove shape constructed such that the back pressure groove is disposed furthest away from a center point of the rotor at positions where the vanes are extended furthest from said center point, and said back pressure groove is disposed closest to said center point of said rotor when said vanes are extended closest to said center point of said rotor.

2. The vane pump according to claim 1, wherein the back pressure groove is formed following the shape of a cam curve of the cam surface along a peripheral direction of the cam ring.

3. The vane pump according to claim 2, wherein the back pressure groove is formed only in one of a pair of plates.

4. The vane pump according to claim 2, wherein the vane pump is a fixed displacement vane pump.

5. The vane pump according to claim 2, wherein the back pressure groove is formed in both of a pair of plates.

6. The vane pump according to claim 1, wherein the back pressure groove is formed as an annular shape of an oval.

7. The vane pump according to claim 6, wherein the vane pump is a fixed displacement vane pump.

8. The vane pump according to claim 1, wherein the back pressure groove is formed only in one of a pair of plates.

9. The vane pump according to claim 8, wherein the vane pump is a fixed displacement vane pump.

10. The vane pump according to claim 1, wherein the back pressure groove is formed in both of a pair of plates.

11. The vane pump according to claim 1, wherein the vane pump is a fixed displacement vane pump.

* * * * *